United States Patent [19]

Gerber

[11] Patent Number: 4,587,873

[45] Date of Patent: May 13, 1986

[54] APPARATUS WITH BELT VALVE VACUUM SYSTEM FOR WORKING ON WORK MATERIAL

[75] Inventor: Heinz J. Gerber, West Hartford, Conn.

[73] Assignee: Gerber Scientific, Inc., South Windsor, Conn.

[21] Appl. No.: 736,838

[22] Filed: May 22, 1985

[51] Int. Cl.[4] ..... B26D 1/00; B26D 7/02

[52] U.S. Cl. ..... 83/100; 83/98; 83/374; 83/451; 83/402; 83/925 CC; 269/21

[58] Field of Search ..... 83/98, 99, 100, 402, 83/925 CC, 374, 422, 451; 269/21

[56] References Cited

U.S. PATENT DOCUMENTS 3,495,492 2/1970 Gerber et al. ..... 83/374 X 4,494,433 1/1985 Gerber ..... 83/925 CC X

*Primary Examiner*—E. R. Kazenske

*Assistant Examiner*—John L. Knoble

*Attorney, Agent, or Firm*—McCormick, Paulding & Huber

[57] ABSTRACT

An apparatus for working on a single layer or a layup of sheet material, or other work material, has a table for supporting the work material with a support surface selected areas of which may be vacuumized. The selective vacuumization of support surface areas is accomplished by a simple valving system interposed between an air plenum and a plurality of individual compartments underlying the work surface, the valving system including an elongated valving member having a plurality of first and second ports distributed along the length thereof, a belt extending along the length of the valving member and overlying the ports and a belt deflector movable along the length of the valving member, the position of the belt deflector determining the selection of which second ports are connected to which first ports. In the selective vacuumization mode of operation a vacuum is applied to the air plenum. The same apparatus however may also be used to provide a positive air pressure over all of the work surface by applying a positive pressure rather than a vacuum to the air plenum, the valving system in this case simultaneously connecting all of the first ports and all of the second ports to one another.

33 Claims, 13 Drawing Figures

APPARATUS WITH BELT VALVE VACUUM SYSTEM FOR WORKING ON WORK MATERIAL

BACKGROUND OF THE INVENTION

This invention relates to an apparatus for working on work material wherein a table has a work material support surface selected areas of which may be vacuumized, and deals more particularly with an improved valving system for such a table, in means for operating such valving system to obtain a desired mode of operation, and in the combination of such valving system with a bristle bed of such table to achieve a desired application of the vacuum to the work material.

Apparatus embodying this invention may be used in many different applications where it is necessary or desirable to have a work material supporting surface selected areas of which may be vacuumized for various purposes. An especially advantageous application of the apparatus is in the textile or upholstery industry where one or more layers of fabric or other sheet material are spread onto a work surface for subsequent cutting or other processing. It may for example be desirable as the sheet material is spread by a spreader onto the work surface to successively vacuumize different transversely extending sections of the work table, in keeping with the movement of the spreader, so that the area of the table at which the sheet material passes from the spreader to the table, and only that area, is subjected to a vacuum to aid in smoothly applying the sheet material to the table. In another case selected areas of the work table may be vacuumized to aid in fixing the layer or layers of sheet material to the table, and also possibly to compress such layer or layers, with or without the use of an overlying air-impermeable sheet, while the layer or layers are cut with the selected area of the work surface subjected to vacuum being one underlying a cutting tool which moves over the work surface. In this case, as the tool moves longitudinally of the work surface different transverse zones or areas are vacuumized and devacuumized in keeping with the movement of the tool, and it is desirable that the degree of vacuum be greatest at the transverse area directly underlying the tool and that the vacuum gradually taper off to zero, as a function of distance from the tool, on either side of the tool longitudinally of the table. It is also desirable in this case as different transverse areas of the work surface become vacuumized and devacuumized, as a result of movement of the tool longitudinally of the work surface, that such vacuumization and devacuumization occur gradually and without any sudden surges as might adversely disturb the sheet material on the work surface.

The ability to vacuumize only an area of the work support surface located in the vicinity of the cutting tool has various benefits, a principal one of which is the ability generally of being able to operate the table with a much less powerful vacuum source than would be required for applying a vacuum over the entire work surface. This is especially true where a layup of sheet material to be cut is covered with an air-impermeable sheet as part of a vacuum holddown means. If vacuum is applied over the entire work surface, before any cutting takes place, the air-impermeable sheet serves as an air seal so that only a relatively low demand is put on the vacuum source. However, as the cutting progresses the cuts made by the cutter in the layup and in the overlying air-impermeable sheet allow air to move through the layup into the vacuum system putting a load on the vacuum source which increases as more and more cuts are made. Also, if the table is used for holding only a single layer, or a few superimposed layers, of air-permeable work material without the use of an overlying air impermeable sheet, if the whole support surface is vacuumized much air will pass into the vacuum system through the work material and require a large capacity vacuum source to maintain a desirable vacuum level at the work support surface. Therefore, in both these cases vacuumizing only a small area of the work support surface obviously reduces the maximum load imposed on the vacuum source and allows a less powerful and more inexpensive one to be used.

The basic idea of applying a vacuum to only a selected area of a work surface, and in making such selection in accordance with the position of a tool or carriage relative to the work surface, is old in the art and shown for example by prior U.S. Pat. No. 3,495,492, of which Applicant is a co-inventor. The present invention relates to further implementations of and improvements in that basic idea.

A general object of the invention is therefore to provide an apparatus with a selectively vacuumizable work material support surface of generally similar principle to that of prior U.S. Pat. No. 3,495,492, but having an improved, less expensive, and more efficient and reliable valving system than previously available in the prior art.

Another object of the invention is to provide an apparatus of the foregoing general characteristics wherein the vacuum applied to the work surface, particularly when supporting one or a few layers of air permeable web material without an air impermeable sheet, has a gradient whereby the degree of vacuum is highest in the immediate vicinity of the tool or carriage and gradually diminishes on opposite sides of the tool or carriage longitudinally of the work surface.

Still another object of the invention is to provide an apparatus of the foregoing character wherein the vacuumization and devacuumization of the different transverse areas of the work surface occur gradually without sudden surges.

Where the selective vacuumization of various areas of a work material supporting surface is controlled by the position of a work tool relative to the work surface it is often desirable that the control of the vacuum valving system impose substantially no additional load on or weight to the tool or its positioning mechanism so that the tool may be driven at as high accelerations and decelerations as possible. A further object of the invention is therefore the provision of an apparatus of the foregoing character wherein the valving system is controlled in response to the position of a tool or tool carriage relative to the work surface without adding a significant demand onto the tool positioning system.

Also, in some apparatuses having a selectively vacuumizable work support surface it may at times be desirable to apply a positive air pressure over the entire work support surface instead of a vacuum over only a portion of the surface. This may be of benefit, for example, where the apparatus is a cloth cutting machine where vacuum is used to hold the material to the work support surface during cutting and where after cutting positive pressure is applied over the entire work support surface to create an air cushion between the support surface and the work material to aid in removing the cut material from the work surface and also possibly to aid in bringing a fresh supply of material onto the surface. Therefore, another object of this invention is to provide an apparatus of the foregoing character wherein a positive air pressure may be created over the entire work support surface by simply applying a positive air pressure, instead of a vacuum, to the air plenum.

Other more detailed objects and advantages of the invention will become apparent from the accompanying detailed description of a preferred embodiment taken in conjunction with the accompanying drawings.

SUMMARY OF THE INVENTION

The invention resides in an apparatus for working on work material wherein a table for supporting the work material has a support surface, made by a bristle bed or other porous or apertured material, over selected areas of which a vacuum may be created. This selective vacuumization of different areas of the support surface is achieved through a valving system including an elongated valving member with a planar valving face containing a plurality of first and second ports distributed along its length, a belt deflector unit movable along the length of said valving member, and a belt associated with the valving member and the deflector unit. Different ones of the first ports communicate with different ones of a plurality of compartments underlying different areas of the work support surface and all of the second ports communicate with an air plenum. The belt extends along the length of the valving member and over the deflector unit in such a way that on opposite sides of the deflector unit the belt is positioned closely adjacent to the valving face, with the belt being held away from the valving face at the deflector unit. When a vacuum is applied to the air plenum, the vacuum appearing at the second ports located remote from the deflector unit draw the adjacent belt portions to the valving face of the valving member to seal such second ports against air flow therethrough, but at the location of the deflector unit, where the belt is held away from the valving face, some first ports communicate with some second ports to allow the vacuum from the air plenum to be communicated to one or more selected compartments. If a positive air pressure is applied to the air plenum, the positive pressure appearing at the second ports pushes the belt away from the valving face so that the positive pressure is communicated to all of the table compartments thereby providing pressurized air over the entire extent of the support surface. If the apparatus is intended to be used with positive pressure sometimes applied to the air plenum, the valving member is part of a substantially sealed chamber containing the belt and belt deflector which chamber also becomes pressurized during pressurization of the air plenum to effectively transmit the positive air pressure from the second ports to the first ports.

The invention also resides in the apparatus including a bristle bed for supporting the work material which bristle bed overlies the compartments, the air flow associated with the vacuumization of a given compartment passing through openings in the base of the bristle bed and the bristles of the bed being relatively short and closely packed so that in the space between the base and the work material the bristles present a substantial resistance to air flow causing the degree of vacuum to be high at the portion of the work surface directly overlying a vacuumized compartment or set of adjacent vacuumized compartments and to diminish with distances from such compartment or set of compartments longitudinally of the work surface.

The invention also resides in the valving member having a large number of first ports for each compartment, and in the deflector unit being so sloped that as the deflector unit is moved toward or away from the first ports for a given compartment the application of vacuum to or the shutting off of vacuum from that compartment occurs in a gradual manner without surges.

The invention also resides in the apparatus including a carriage movable in one coordinate direction relative to the support surface and in a means for moving the belt deflector in synchronism with the carriage so that, when a vacuum is applied to the air plenum, the selected compartment or compartments underlie, for example, a tool carried by the carriage.

The invention still further resides in various details of construction and combinations as set out more clearly in the claims.

DETAILED DESCRIPTION OF THE PREFERRED EMBODIMENT

Figure 1:
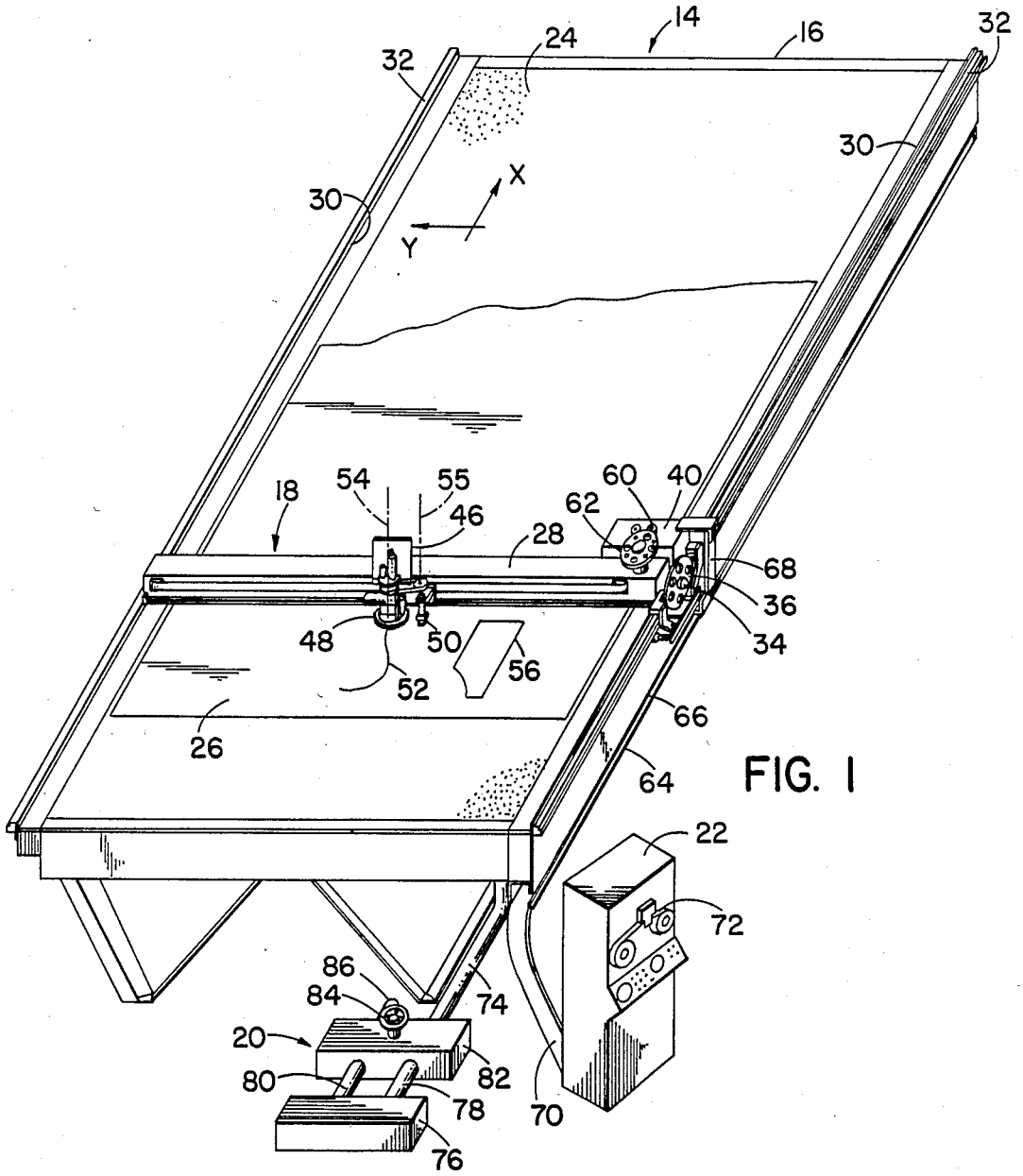
FIG. 1 is a perspective view of an apparatus, in the form of a cloth cutting machine, embodying the present invention.
Figure 2:
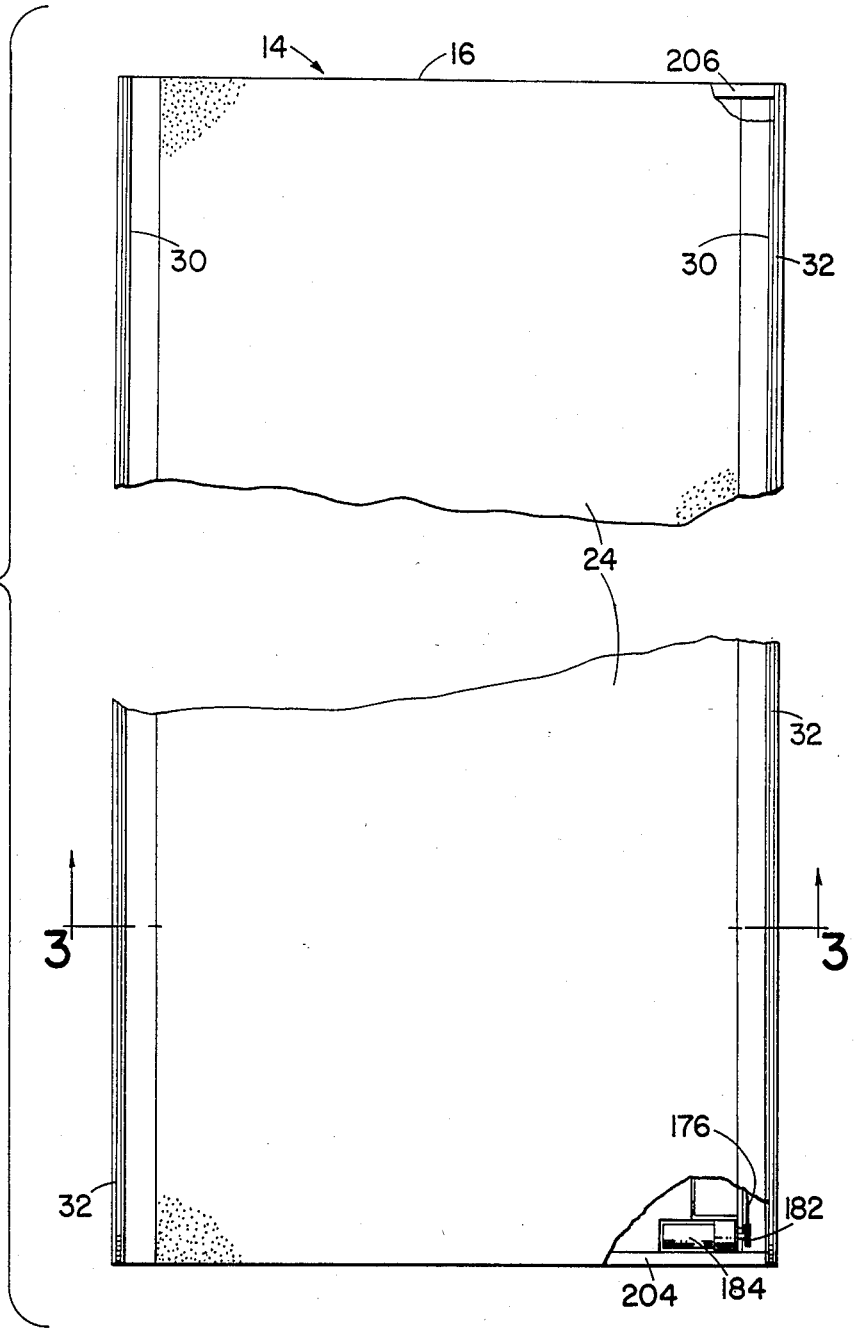
FIG. 2 is a fragmentary plan view of the table of the FIG. 1 apparatus.

Turning to FIG. 1, the invention is there shown as embodied in an apparatus 14 adapted to the cutting of either a single layer or a layup of sheet material spread on a work supporting surface. The apparatus by way of major components is comprised of a cutting table 16, a cutting mechanism 18, an air system 20 and a numerical controller 22.

The table 16 has an elongated, rectangular, horizontal and upwardly facing work support surface 24 which in the illustrated case is used to support a single sheet of cloth 26, as the work material, in a spread condition. The material forming the work support surface 24 may vary widely, but in the illustrated and preferred case, and in keeping with some aspects of the invention, as explained in more detail hereinafter, it is made up of a plurality of bristle elements or blocks fitted together to form a continuous bristle bed with the bed having a large number of air transmitting passages extending vertically through it to allow air to pass between the work support surface 24 and hollow compartments underlying the surface 24 as part of a system for creating a vacuum over a selected area of the surface 24, to aid in holding in place the material 26 as it is cut, and also possibly for creating a positive air pressure over the entire extent of the surface 24 to aid in moving the material 26 onto or off of the surface 24.

Figure 12:
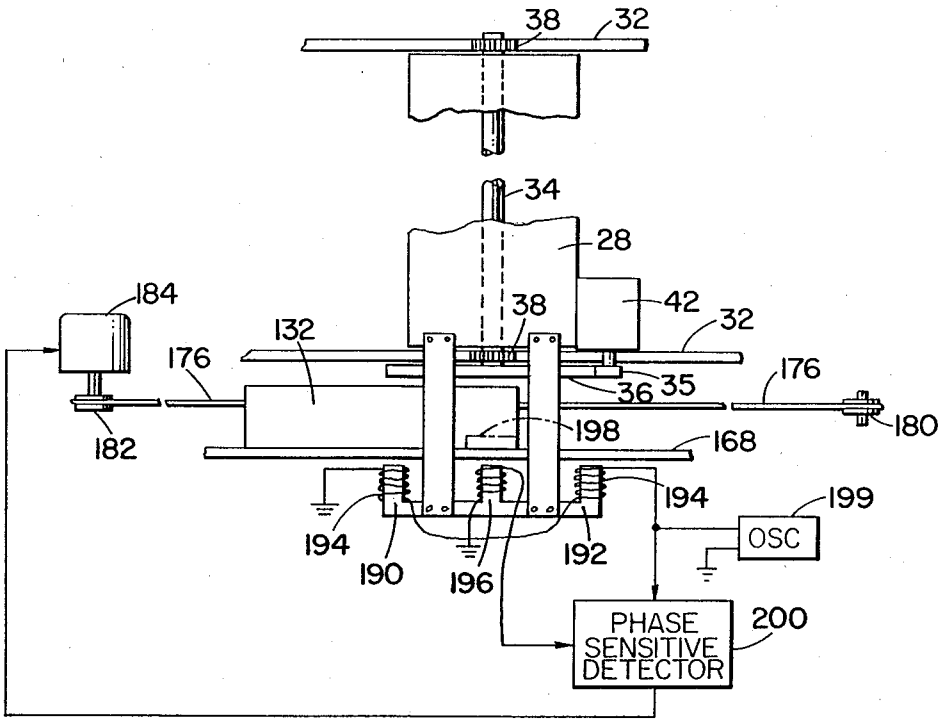
FIG. 12 is a somewhat schematic view of the system used in the apparatus of FIG. 1 for positioning the belt deflector in accordance with the X-carriage.

The cutting mechanism 18 includes an X-carriage 28 located above the support surface 24 and movable in the illustrated X-coordinate direction relative to the table 16. It is supported at its opposite ends by suitable bearings (not shown) engageable with upwardly projecting walls 30, 30 on opposite longitudinal sides of the table. On the outboard surface of each wall is a longitudinally extending rack 32. A drive shaft 34, having a drive gear 36 fixed to its right-hand end, as seen in FIGS. 1 and 12, extends through the carriage 28 and has a pinion 38 on each of its opposite ends engageable with the associated rack 32 to move the carriage in the X-direction in response to rotation of the drive gear 36 and shaft 34. Carried by a service module 40 fixed to the right-hand end of the X-carriage, as seen in FIG. 1, is an X-motor 42 (see FIG. 12) having an output pinion 35 which meshes with and drives the drive gear 36.

Supported on the X-carriage 28 for movement relative to it in the illustrated Y-coordinate direction, is a Y-carriage 46 which carries one or more work tools for working on the work material 26 spread on the supporting surface 24. These tools may take various different forms, but in the illustrated case are shown to consist of a rotating blade cutting head 48 and a reciprocating blade head 50. The head 48 has a blade, rotatable about a generally horizontal axis, to cut the material 26 along a given line of cut 52 as the head 48 is moved along such line, under control of the controller 22, by combined movement of the X-carriage 28 and Y-carriage 46 in the X- and Y-coordinate directions. During such movement the portion of the head 48 carrying the rotating blade is movable about a vertical $\theta$-axis 54 to maintain the cutting blade tangent to the line of cut 52 and the vertically extending blade of the reciprocating blade is likewise movable about a vertical $\theta$-axis 55. In general, the cutting head 48 is used to cut pattern pieces from the material 26 with one such pattern piece being shown for example at 56. The head 50 has a vertically movable blade and may be used to cut notch marks in the pattern pieces cut by the cutter head 48. It can also be used to cut some portions of the lines of cut defining the pattern pieces as, for example, portions of such lines having curvatures smaller than easily cut by the rotating blade cutter head 48.

The Y-carriage 46 is moved in the Y-coordinate direction by a belt 58 passing over pulleys at opposite ends of the X-carriage 28. The right-hand one of these pulleys, as seen in FIG. 1, is driven by a Y-motor (not shown) contained in the service module 40 and having a pinion 60 on its drive shaft which meshes with a drive gear 62 in turn drivingly connected with the belt drum.

Power and electrical commands for operating the X- and Y-drive motors in the service module 40 and for operating the cutting heads 48 and 50 are supplied from a ribbon cable contained in a cable housing 64 running along the right-hand side of the table and having a longitudinally extending slot 66 providing access to the cable. One end of the cable is connected to a conductor carrying arm 68 connected to the X-carriage 28 and the other end of the cable is connected to the numerical controller 22 through a connecting cable 70 which may be a continuation of the cable contained in the housing 64.

The numerical controller 22 which may, as illustrated, operate in response to instructions recorded on magnetic tape 72, provides the power and commands needed to operate the cutting table 16, and in particular to move the cutting head 48 along the desired lines of cut on the work material 26.

The air system 20 is connected to the table through a supply conduit 74 and operates to selectively apply either a vacuum or a positive pressure to that conduit. For this reason, the system consists of a blower or pump 76 having both a vacuum port 78 and a pressure port 80. Connected between the pump 76 and the supply conduit 74 is a valve mechanism 82 manually operable by a handle 84 for selectively connecting the supply conduit 74 to either the vacuum port 78 or the pressure port 80. The port 78 or 80 not connected to the supply conduit 74 is connected by the valve mechanism 82 to an atmospheric port 86. Therefore, if the valve mechanism 82 is set to supply a vacuum to the table 16 air will be drawn into the pump 76 through the supply conduit 74 and exhausted through the atmospheric port 86. On the other hand, if the valve mechanism is set to supply positive air pressure to the table air will be drawn into the pump 76 through the atmospheric port 86 and discharged at an above atmospheric pressure into the supply conduit 74.

Reference may now be made to FIGS. 2 to 5 for a more detailed description of the table and the way it is divided into a number of transversely extending areas arranged side-by-side and selected ones of which may be vacuumized.

Figure 3:
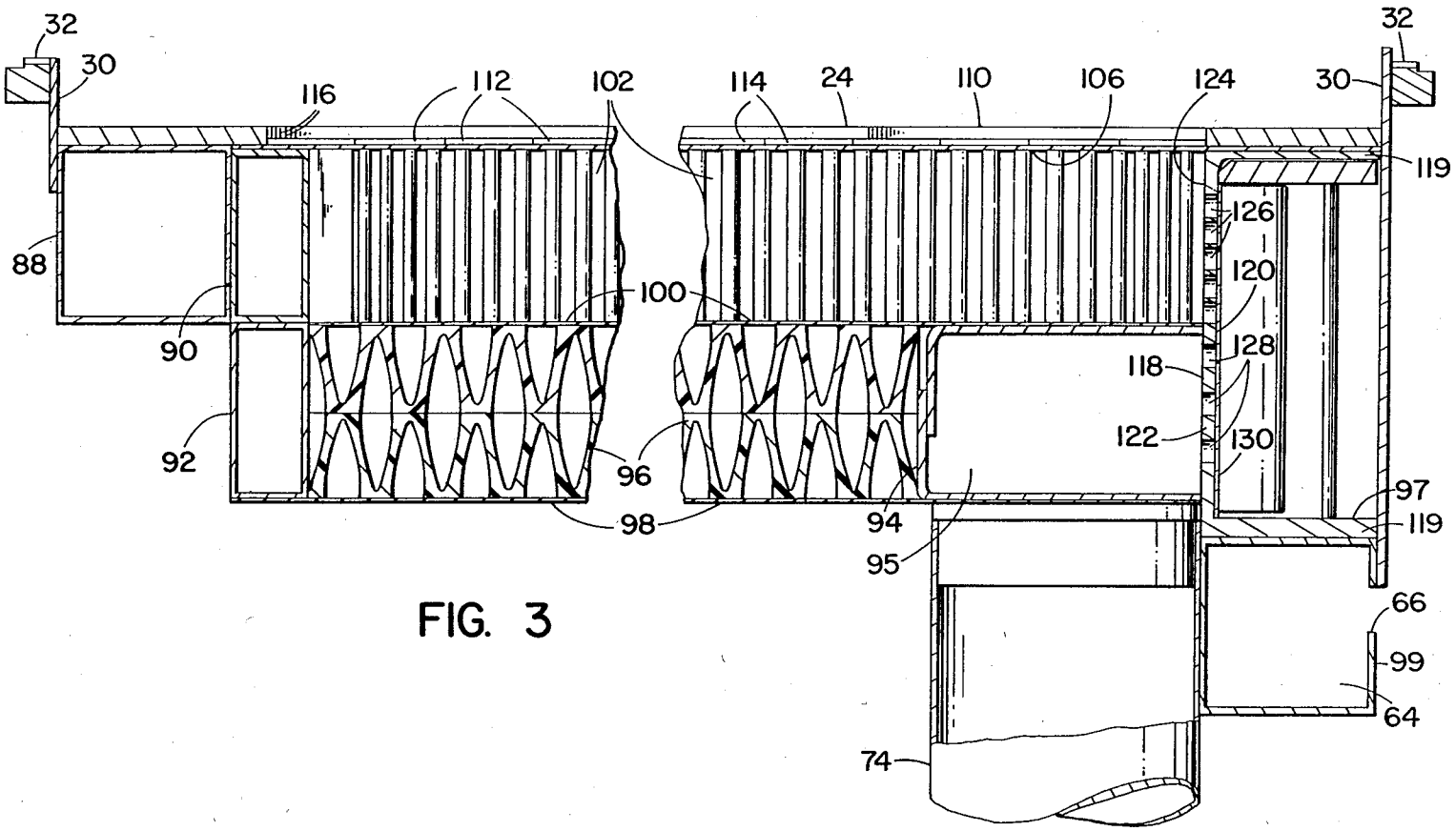
FIG. 3 is a transverse vertical fragmentary sectional view, on an enlarged scale, taken on the line 3—3 of FIG. 2.

As shown in these figures, particularly FIG. 3, the framework of the table includes a number of longitudinally extending members 88, 90, 92, 94, 97 and 99, preferably made of aluminum, welded or otherwise joined to one another in the arrangement shown. The member 99 forms the cable housing 64. The member 94, in conjunction with part of the member 97, forms an air plenum 95 connected to the supply conduit 74. This member 94 and the member 92, as seen best in FIG. 3, are located at the lower level of the table and between them is a rigid but lightweight base block made of a honeycomb body 96 sandwiched between two aluminum sheets 98 and 100. The top sheet 100 forms the bottom wall of a number of compartments 102, 102 separated from one another by partitions 104, 104 of corrugated aluminum sheet extending upwardly from the horizontal sheet 100 and extending transversely of the table. The partitions are imperforate and extend all the way between the members 98 and 90 so that each compartment 102 is closed against the ingress or egress of air except through its top portion and its right-hand end portion as explained in more detail hereinafter. The spacing between the partitions longitudinally of the table may vary, but in the illustrated case such spacing is taken to be two inches, thereby making each compartment two inches wide.

The partitions 104, 104 in addition to defining the compartments 102,. 102 also act as supports for supporting the components of the supporting surface 24. As seen best in FIGS. 3 and 5 these components include a rigid metal base 106 in the form of a sheet or plate, preferably of aluminum, resting directly on the upper sides of the partitions 104, 104 and having a large number of apertures 108, 108 evenly distributed over its entire extent. The base plate 106 in turn supports a bristle bed 110 the upper ends of the bristles of which define the support surface 24. The exact structure of the bristle bed may vary, but prefereably it is one such as shown and described in more detail in my patent application filed concurrently herewith entitled "Apparatus and Method for Supporting and Working on Sheet Material", which may be turned to for further details and which is incorporated herein by reference. For the present purposes it may be noted that it is comprised of a plurality of individual bristle blocks 112, 112, of square shape in plan view, which are fitted adjacent to one another to make up the overall bristle bed. Each bristle block has a base layer 114 which is apertured, as shown at 113, 113 in FIG. 6, to allow air to freely pass vertically therethrough and which base layer carries a large number of bristles 116 which extend vertically upwardly therefrom. Each bristle block is secured to the base plate 106 in a convenient way as for example by having one or more downwardly extending posts which snap into complementary openings in the base 106. Therefore, if the bristles of one or more bristle blocks become damaged those blocks may be replaced by new ones without having to replace the entire bristle bed 110.

By way of example, and in keeping with my aforesaid concurrently filed patent application, in the illustrated case each bristle block 112 is taken to have a length of two inches on each side so as thereby to provide four square inches of the support surface 24. The block is a one piece injection molded unit made of a suitable plastic such as nylon or polypropylene. The base layer is approximately one-eighth inch thick and the bristles are approximately 0.300 inches long. Each bristle has a diameter of about 0.026 inches adjacent to base layer 114 and maintains substantially that diameter, with only a very slight taper, for about ¾ of the length, after which it tapers to a point at its upper end. The bristles are regularly arranged on the base layer 114, except for a missing bristle at each aperture 113 in the base layer 114, there being eighty eight such apertures of approximately 0.050 diameter in the base layer 114 of each block. Further, each block contains approximately 2800 bristles. Consequently, in the bristle bed 110, the space between the base layers 114, 114 of the bristle blocks and the supporting surface 24 is of relatively short vertical extent and is relatively densely occupied by the bristles 116, 116. The bristles, therefore, present a substantial resistance to the free flow of air through such space in a plane parallel to the base layers 114, 114. When the support 24 is entirely covered with an air permeable sheet which itself has some resistance to the flow of air therethrough, and one or a set of adjacent compartments are vacummized, due to the resistance provided by the bristles, a tapered distribution of vacuum appears on the support surface such as shown in FIG. 13.

Figure 13:
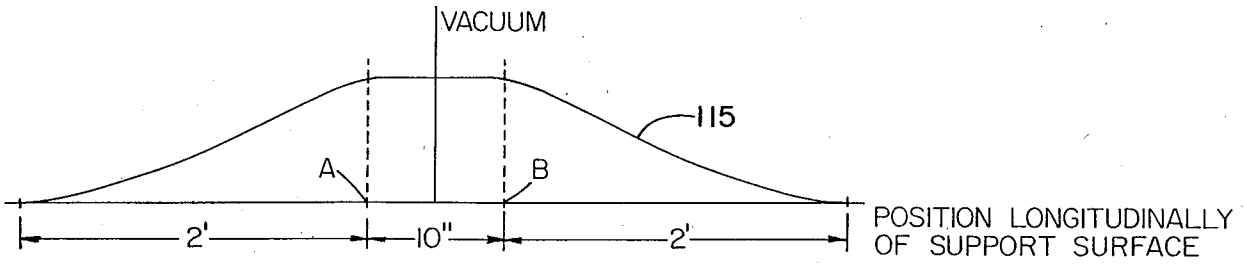
FIG. 13 is a graphical representation showing the manner in which the vacuum is applied longitudinally of the support surface in the apparatus of FIG. 1 when the support surface is entirely covered with a sheet of air permeable material offering some resistance to the flow of air therethrough.

In FIG. 13 the longitudinal axis represents positions longitudinally of the support surface 24 and the vertical axis degree of vacuum, the line 115 in turn representing the degree of vacuum appearing at various longitudinal table positons. The distance between the points A and B represents the portion of the support surface beneath which compartments are vacuumized. As explained in more detail hereinafter, the valving mechanism in the illustrated case is designed so that essentialy five adjacent compartments 102, 102 are vacuumized at one time thereby making the portion of the surface 24 directly over vacuumized compartments ten inches long. Over this portion of the surface 24 the degree of vacuum is at the highest value, and on either side of this portion longitudinally of the table the degree of vacuum gradually diminishes toward zero with increasing displacement from the adjacent point A or B. The point at which the vacuum reaches an essentially zero value depends on many factors, but in a typical case as shown in FIG. 13 such point may be located about two feet from the adjacent point A or B.

In any event, the apertures in the base 106 and in the bristle blocks 112, 112, allow air to pass freely between the support surface 24 and each underlying compartment 102. Therefore, when vacuum is applied to any one compartment 102 that vacuum is transmitted directly through the top of the compartment to the portion or area of the support surface 24 directly overlying that compartment, with some of the vacuum also spreading out longitudinally of the table through the bristle containing space of the bristle bed. Similarly, if a positive air pressure is applied to a compartment, such positive pressure is also transmitted through the base 106 and bristle bed 110 to cause a positive pressure to appear over that portion of the surface 24 overlying that compartment.

In accordance with the invention, the compartments 102, 102 are selectively vacuumizable by means of a simple belt valve mechanism located along one side of the table cooperating with the air plenum 95 and with the adjacent ends of the various compartments 102, 102. As seen in the accompanying drawings, the belt valve is located along the right side of the table and includes as part of its structure the channel-shaped frame member 97. The member 97 has a web 118 and two horizontal flanges 119, 119. With regard to the valving mechanism the web 118 constitutes a valving member extending longitudinally of the table and having a valving face 120. The valving member 118 is located in a vertical plane and has a lower longitudinally extending portion 122 aligned with the member 94 and forming the right-hand wall of the air plenum 95. Another, upper longitudinally extending portion 124 of the valving member 118 is aligned with the right-hand ends of the compartments 102, 102 and forms the right-hand end walls of such compartments. A large number of holes extending through the valving member 118 are provided in each of the longitudinally extending portions 122, 124 of the valving member. The holes in the upper longitudinally extending portion 124 extend through the valving member to provide a series of first ports 126 on the valving face 120, and the holes in the bottom longitudinal portion 122 extend through the valving member to provide a series of second ports 128 on the valving face 120. As shown, for example in FIG. 5, for each compartment 102 there preferably are a large number of ports 126 and 128 in the valving face. The number and arrangement of these ports for each compartment may vary, but in any event there is at least one port 126 and one port 128 in the valving face for each compartment.

Cooperating with the valving face 120 of the valving member 118 is a belt 130 and a belt deflector unit 132. The belt 130 extends along the entire length of the valving member 118 while the belt deflector unit has a total length equal to the length of only a small number of side-by-side compartments 102, 102. The belt deflector unit is further selectively movable to different positions along the length of the valving member.

Figure 5:
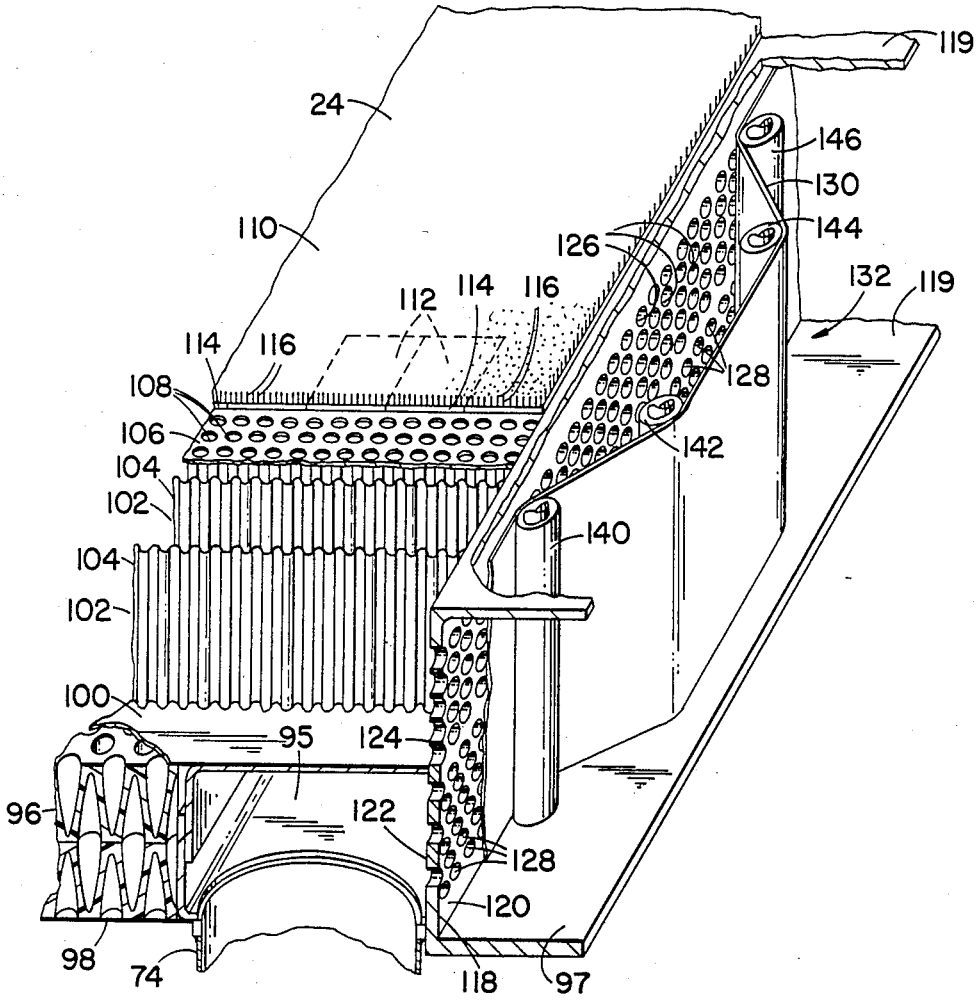
FIG. 5 is a fragmentary schematic view of the table of the FIG. 1 apparatus showing how the belt deflector unit deflects the belt of the belt valve to obtain a valving action, all parts of the deflector unit except for its four deflector rolls being omitted for purposes of clarity.

The general operation of the belt and belt deflector, when a vacuum is applied to the air plenum 95, is that on opposite sides of the deflector unit the belt is positioned against the valving face 120 to seal the associated first and second ports 126 and 128 from one another and to thereby prevent vacuum from being transmitted from the plenum 95 to the associated compartments 102, 102. At the location of the belt deflector unit 132, however, the belt is held away from the valving face 120, as best seen in FIG. 5, to provide communication between those first and second ports 126 and 128 adjacent the deflector unit thereby causing one or a few compartments 102, 102 to be supplied with vacuum. The number of compartments vacuumized depends on the length of the deflected portion of the belt with such length in the illustrated case being one causing essentially five compartments 102, 102 to be vacuumized at one time.

The construction of the belt deflector unit may vary, but for purposes of explanation one such construction is shown in detail in FIGS. 4 and 6 to 11. Referring first to FIGS. 4 and 6 to 9, the belt deflector unit 132 is made up of a frame 134 comprised basically of an upper horizontal bar 136 and two vertical bars 138, 138, at opposite ends of the unit, rigidly fixed to and extending downwardly from the upper bar 136. The upper bar provides the sole support for four rolls 140, 142, 144 and 146 which engage and deflect the belt 130 in the manner best seen in FIG. 5. The fact that the rolls 140, 142, 144 and 146 are supported only at their upper ends by the bar 136 allows the belt 130 to rest with its lower edge against the bottom flange 119 both at the location of the belt deflector unit and along those portions of the belt located on opposite sides of the unit. The belt is therefore vertically supported by the bottom flange 119 against slipping due to gravity relative to the valving face 120.

Figure 10:
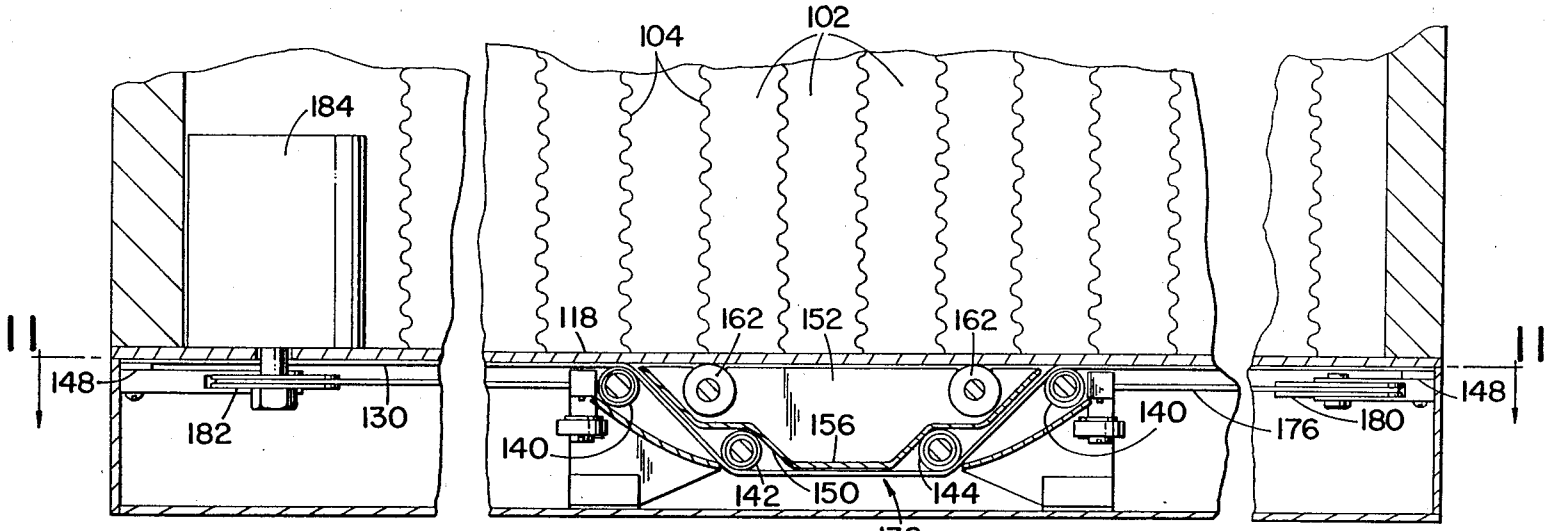
FIG. 10 is a simplified schematic view taken generally on the line 10—10 of FIG. 6 showing the basic make up of the valving system.

The two end rolls 140 and 146 of the belt deflector unit are located close to the valving surface 120 so that the belt 130 in passing between each roll and the valving surface is held against the valving face. In conjunction with this, and as shown in FIG. 10, each end of the belt, at opposite ends of the table, is fixed to the valving member by a vertically extending clamping bar 148, and associated screws threaded into the valving member, which holds the associated end of the belt against the valving face. The belt 130 is made of an air-impermeable material and in being fixed to the valving member by the clamping bars 148, 148 is fixed in a taut condition so that by its tautness it is held close to the valving face in the areas thereof remote from the belt deflector unit.

Figure 9:
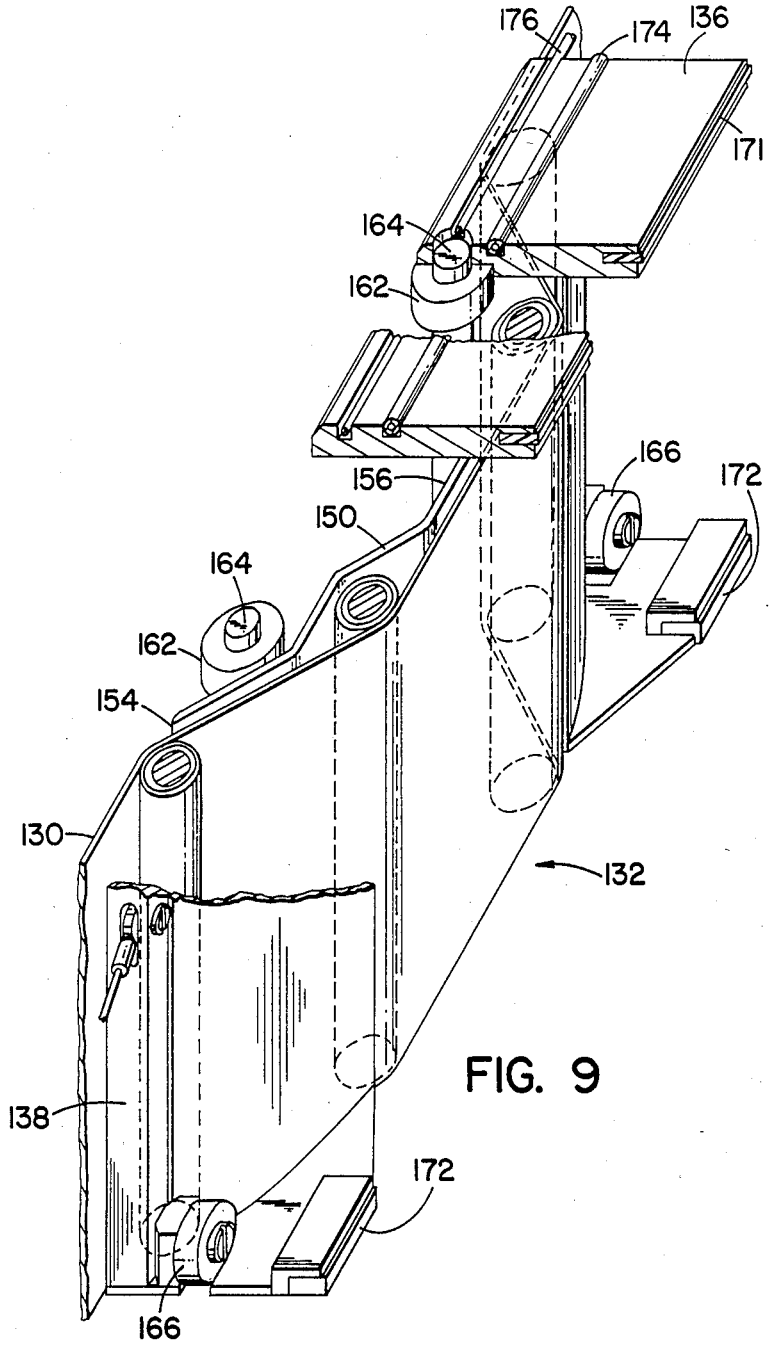
FIG. 9 is a perspective view taken in substantially the same direction as FIG. 5 but showing further details of the deflector unit.
Figure 11:
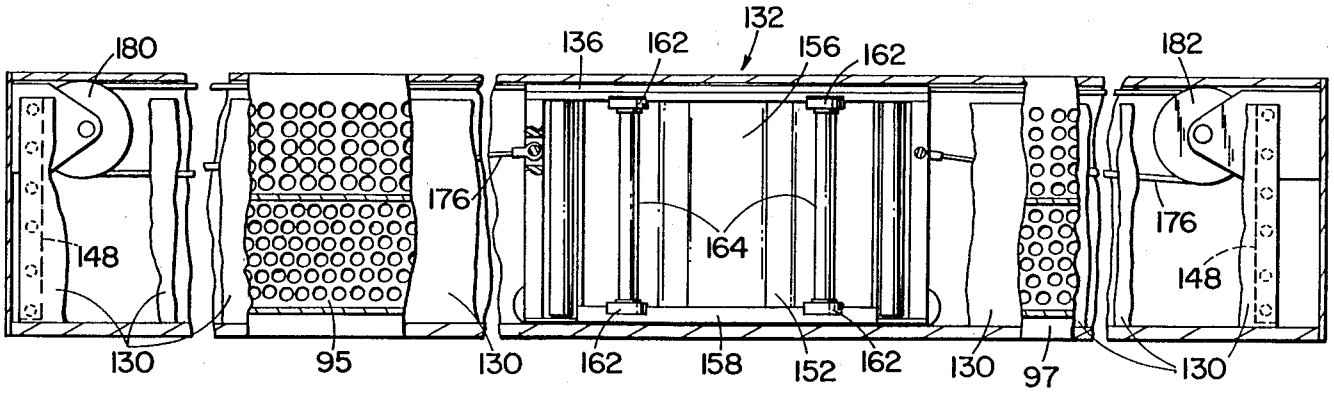
FIG. 11 is another simplified schematic view taken generally on the line 11—11 of FIG. 10 with various ports being shown broken away to reveal the presence and structure of underlying parts.

To inhibit the leakage of air at the deflector unit, the unit also preferably, as illustrated, includes a housing 150 over which the belt 130 passes. This housing has an open face 152 (see FIG. 11) facing the valving face 120 of the valving member 118 and defined by a rectangular peripheral edge 154 located close to the valving face 120. Therefore, the space provided by the housing 150 allows those first and second ports embraced by the housing to freely communicate with one another with such space being effectively sealed from the surrounding space to prevent the ingress of extraneous air into the housing space. As shown in FIGS. 9, 10 and 11, the housing 150 consists of a vertical wall 156 which at its upper edge is welded to the horizontal bar 136 so that the bar 136 itself forms a part of the housing 150. At the lower edge of the vertical wall 156 the housing 150 includes a bottom wall 158, as seen in FIG. 11. The vertical side portions of the peripheral edge 154 are each located quite close to the associated one of the rolls 140 or 146 to limit air leakage.

The belt deflector unit may be supported for merely sliding movement within the channel member 97, but preferably, and as shown, a number of wheels, as well as sliding bearings, are provided to facilitate the unit's movement along the length of the valving member. These members include four wheels 162, 162 located within the housing 150 and engageable with the valving face 120, as shown best in FIGS. 8 and 9. The wheels 162, 162 comprise two pairs with each pair being supported by one vertical shaft 164. Two other wheels 166, 166, each carried by a respective one of the posts 138, 138, roll on the lower flange 119 of the member 97.

The outboard open face of the member 97 is closed by a coverplate 168 the upper portion of which forms the right-hand wall 30. The member 97 and the coverplate 168 therefore define an elongated four-sided chamber 170 containing the belt deflector unit 132. Further support for the movement of the belt deflector unit longitudinally of the valving member, in addition to the wheels 162 and 166 already mentioned, is provided by a sliding bearing strip 171 carried by the bar 136 and two shorter guide strips 172, 172 located at the bottom of the deflector unit as shown in FIG. 9. The strips 171, 172 may be made of nylon, teflon, or other suitable low-friction material and are engageable with the inside face of the coverplate 168 to restrain the deflector unit from moving laterally in the direction away from the valving face 120.

As seen in FIG. 9 the upper face of the bar 136 of the deflector unit 132 also carries a longitudinally extending seal member 174 which is engageable with the lower surface of the upper flange 119 of the member 97 to provide an additional seal against the ingress of extraneous air into the vacuum system.

Figure 4:
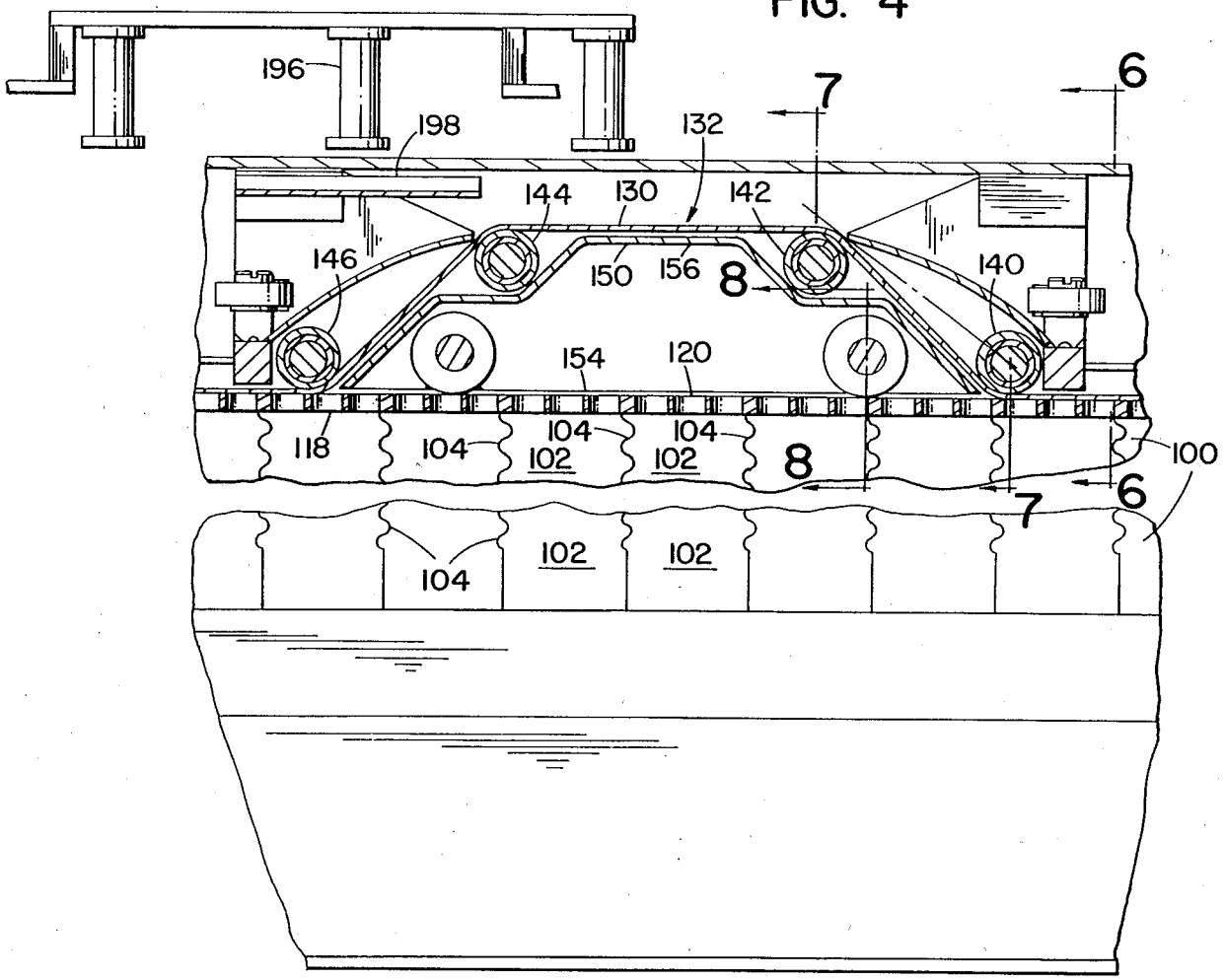
FIG. 4 is a horizontal fragmentary section view, drawn on a still further enlarged scale, taken on the line 4—4 of FIG. 3.

From the foregoing it should be noted that because the valving system number 118 contains a large number of parts 126 and 128 for each compartment 102, as the deflector unit moves longitudinally of the valving member the degree of communication between an on-coming or off-going compartment and the air plenum 95 is gradually valved from fully open to fully closed or vice versa. Therefore, even when the deflector unit is moved at maximum speed the transistion of a compartment from a non-vacuumized to a vacuumized state or vice versa occurs smoothly and without surges that might otherwise disturb the material spread on the support surface. This gradual vacuumization or devacuumization of a compartment is further enhanced by the shape of the housing 150, as best seen in FIG. 4, whereby at either longitudinal end of the housing, where the turning-on or turning-off valving action actually occurs, the housing is tapered so that the housing space is gradually introduced to or removed from ports as the housing moves onto or off of them.

Figure 6:
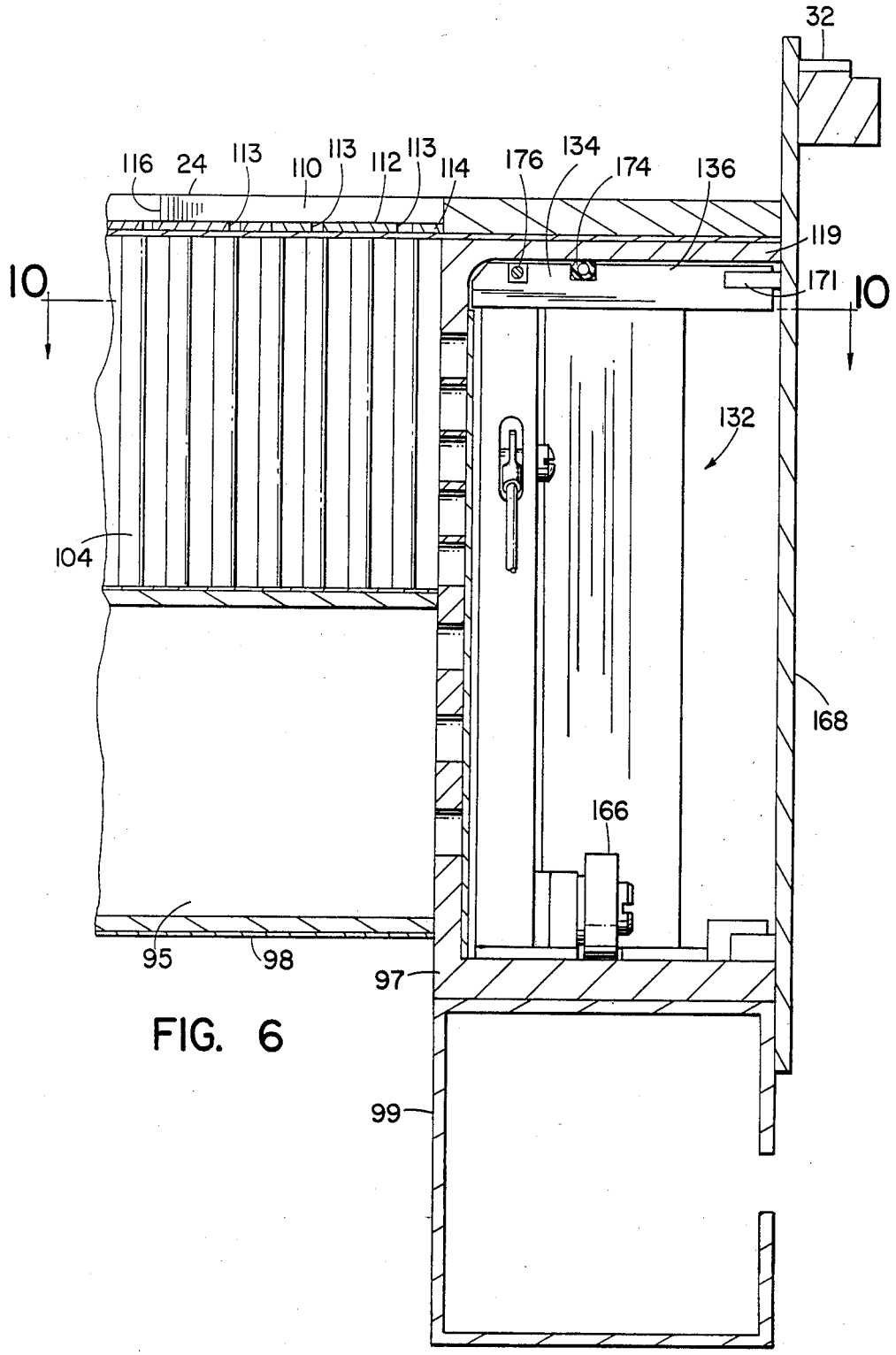
FIG. 6 is a fragmentary vertical sectional view taken on the line 6—6 of FIG. 4.
Figure 7:
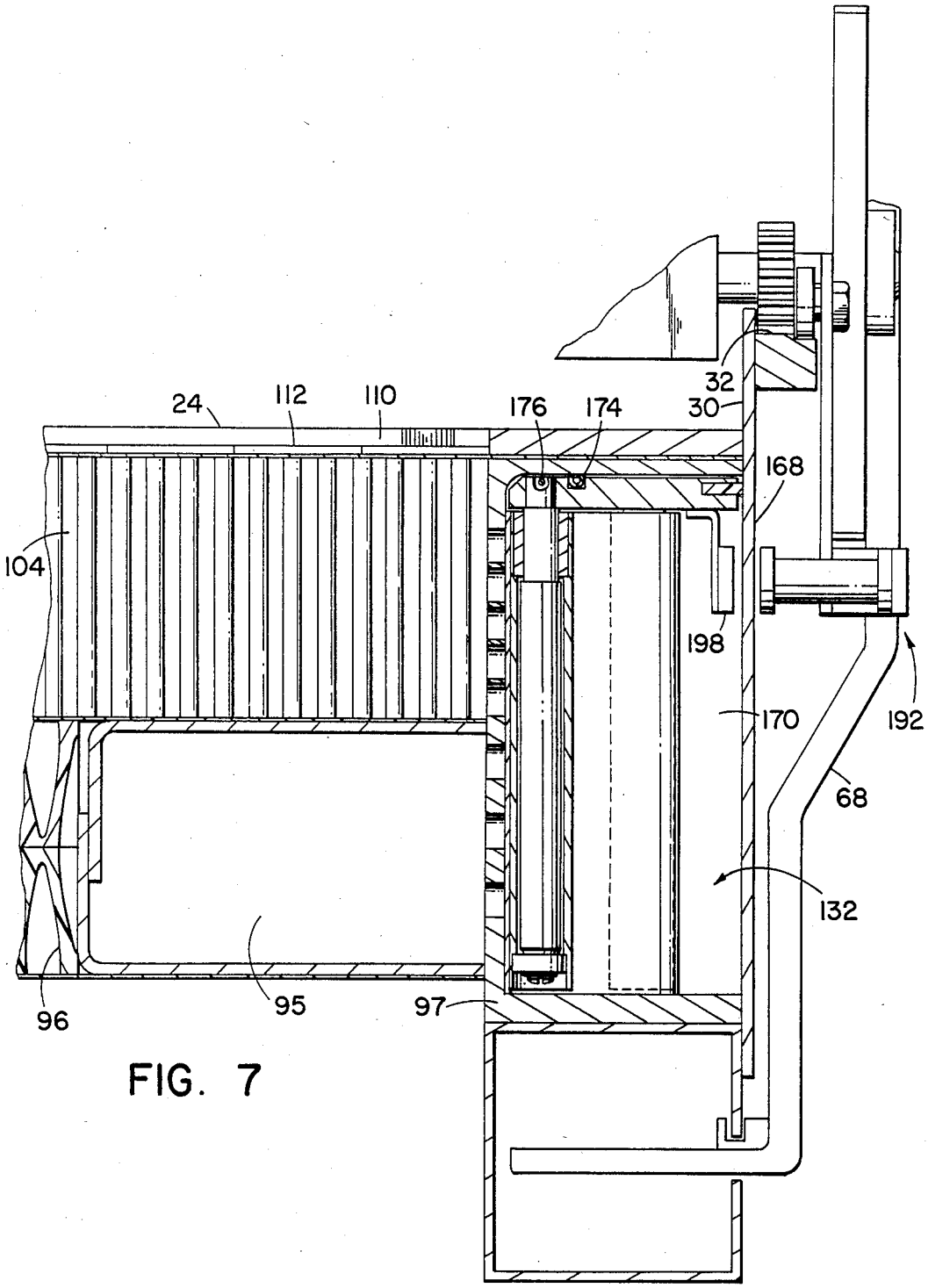
FIG. 7 is a fragmentary vertical sectional view taken on the line 7—7 of FIG. 4.
Figure 8:
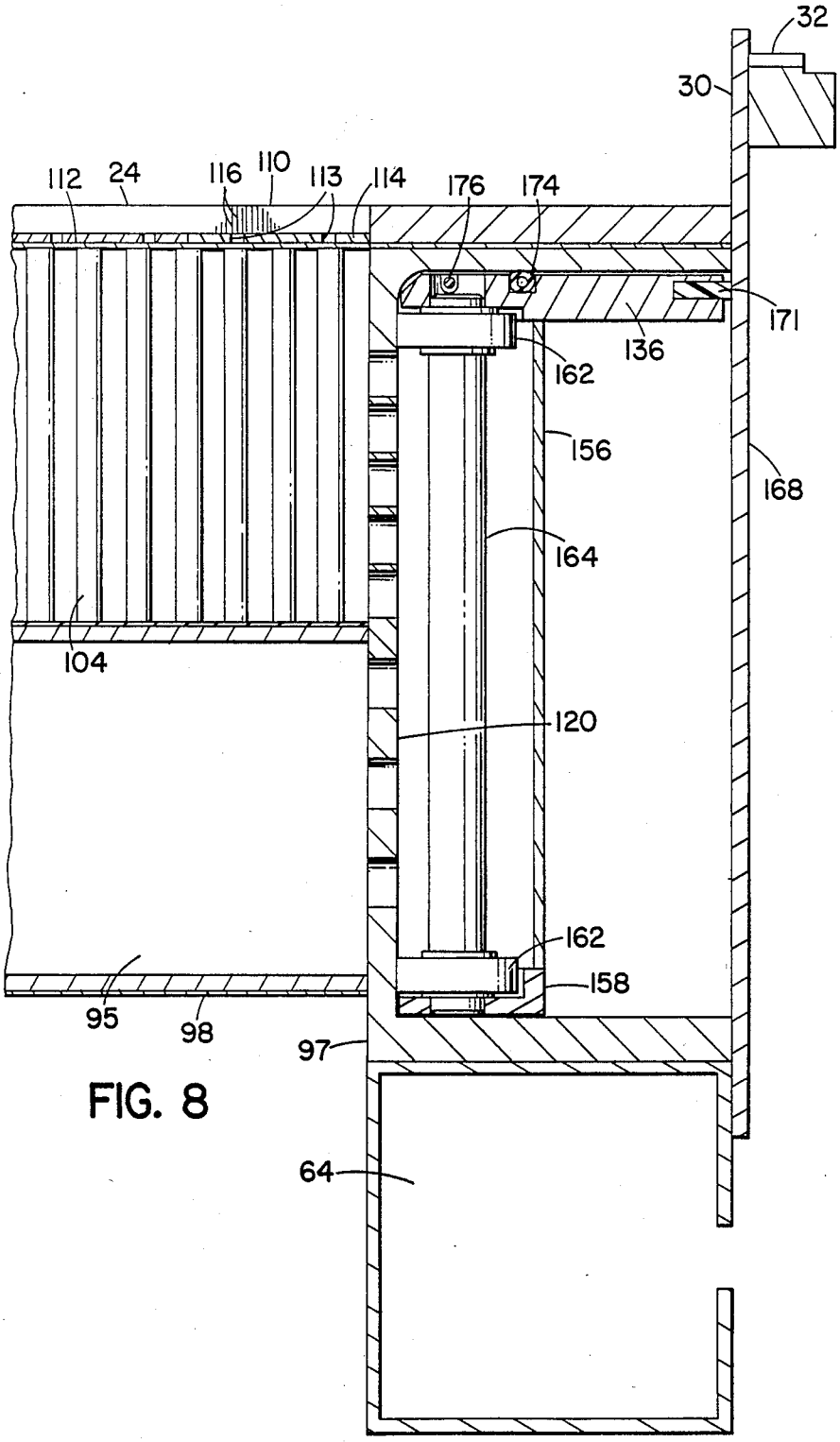
FIG. 8 is a fragmentary vertical sectional view taken on the line 8—8 of FIG. 4.

Movement of the belt deflector unit 132 longitudinally of the valving member 118 is effected by means of a cable drive consisting of a cable 176, best seen in FIGS. 10 and 11, having its opposite ends fixed to the frame of the deflector unit, trained over an idler pulley 180 at one end of the table, and trained over a drive pulley 182 at the opposite end of the table, the drive pulley 182 being mounted on the output shaft of a positioning motor 184. The upper or return run of the cable 176 passes through a slot in the upper face of the upper bar 136 of the unit, as shown in FIGS. 6, 7 and 8.

Generally, it is desirable that the belt deflector unit be moved in unison with the movement of the X-carriage 28 in the X-coordinate direction so that the area of the support surface 24 subjected to vacuum is one which underlies the tool or tools, such as the cutters 48 and 50, of the Y-carriage 46. In some instances the belt deflector unit may, if desired, be mechanically connected with the X-carriage so as to be moved along with it and powered by the same motor as positions the X-carriage. However, in many instances it may be desirable to have the belt deflector unit impose no additional demand on the positioning system for the X-carriage, and this is accomplished in the illustrated system by having the belt deflector unit positioned by its own positioning motor 184. This motor 184 is in turn controlled to vary the position of the belt deflector unit in accordance with changes in the position of the X-carriage 28 relative to the table.

Such synchronous operation may be obviously obtained in a wide variety of ways, but in the preferred and illustrated case it is accomplished through the use of a system, such as shown schematically in FIG. 12, employing an LVDT (linear variable differential transformer) 190, for sensing relative displacement between the X-carriage 28 and the belt deflector unit 132, and an associated nulling system, including the positioning motor 184, for returning or maintaining such sensed relative displacement to a zero or null value. As shown in FIG. 12 the LVDT 190 includes a coil unit 192 fixed to the carriage 28 and having a core carrying two series connected exciting coils 194, 194 and one sensing coil 196. This coil unit 192 cooperates with a ferromagnetic core 198 fixed to the belt deflector unit 132. The belt, the belt deflector unit, the member 97 and the coverplate 168 are all made of aluminum or other nonmagnetic material so that the core 198 is the only element in the vicinity of the coil unit 192 to which the coil unit is sensitive.

The exciting coils 194, 194 of the LVDT are excited by voltage and current from an oscillator 199 which also supplies the same voltage to a phase sensitive detector 200. The voltage induced in or picked up by the sensing coil 196 is likewise supplied to the phase sensitive detector 200. As is well known, the voltage signal picked up by the sensing coil 196 will be zero when the core 198 is at a given zero position relative to the coil unit 192. If the core 198 is displaced in one direction from this zero position the voltage induced in the sensing coil 196 will be in phase with the voltage supplied to the exciting coils and will have a magnitude dependent on the magnitude of the relative displacement from the zero position. On the other hand, if the core 198 is displaced in the opposite direction from the zero position the voltage induced in the sensing coil 196 will be 180 degrees out of phase with the oscillator voltage and will have a magnitude dependent on the magnitude of the relative displacement from the zero position. The phase sensitive detector in turn, as is well known, operates to provide a signal, dependent on the phase and magnitude of the sensing coil signal, to the positioning motor to operate the motor 184 in the direction required to bring the core 198 back to the zero position relative to the coil unit 192, and thereby to maintain the belt deflector unit at the desired relative position with respect to the X-carriage 28.

The above described valve system for selectively connecting different areas of the support surface to a vacuum supply has a number of advantages when used solely with a vacuum in the air plenum 95. Another advantage, however, is that the same valving system may also be used, if desired, with air pressure in the air plenum to provide a positive air pressure over the entire supporting surface 24 as may for example be beneficial when moving work material onto or off of the support surface. If such operation with a positive air pressure in the air plenum is desired the chamber containing the belt deflector unit should be sealed, except for the first and second ports 126, 128 in the valving member. Such sealing is provided in the illustrated case by the flanges 119, 119 of the member 97, the coverplate 168 and suitable end sealing members 204, 206 (see FIG. 2) at opposite ends of the member 97. Therefore, if positive air pressure is supplied to the air plenum 95 air at this pressure will pass through the ports 128 in the lower portion of the valving member 118 and push the belt 130 away from the valving face along the extent of such face 120 located on opposite sides of the belt deflector unit. Thus, air at the positive air pressure will be free to flow from the ports 128 to the ports 126 along the full extent of the valving member 118 providing positive air pressure to all of the compartments 102, 102 and thereby in turn providing positive air pressure over the entire extent of the supporting surface 24.

In the foregoing the invention has been described by way of example as embodied by one structure, but such description is not intended to be limiting and instead various changes and modifications may be made without departing from the invention. For instance in wide tables it may be desirable to have an air plenum and valving system such as described above extending along both sides of the table with the two deflector units of the two valving systems being driven in unison with one another, and such use of two valving systems per table rather than one is intended to be within the scope of the invention.

We claim:

1. An apparatus for working on work material, said apparatus comprising:

a table for supporting work material and including, a top layer of material providing a work material support surface and having air passages extending vertically therethrough and distributed over said support surface, means located below said top layer of material for vertically supporting said top layer and forming a plurality of compartments each having a top communicating with the air passages of that portion of said top layer overlying said compartment, means providing an air plenum, an elongated rigid air valving member having a valving face extending along its length, means defining a plurality of first ports and a plurality of second ports in said valving face, said valving face having a plurality of successive areas arranged in a row along its length with there being at least one of said first ports and at least one of said second ports located in each of said areas, means providing communication between said at least one first port of each of said areas and an exclusively associated one of said compartments, means providing communication between said at least one second port of each of said areas and said air plenum, a belt deflector unit movable along the length of said valving face, an air valving belt extending along the length of said valving face and cooperating with said belt deflector unit, means positioning the longitudinal portion of said belt located on either side of said deflector unit closely adjacent to said valving face, said belt deflector unit having means for deflecting said belt away from and holding it in spaced relation to said valving face at the location of said deflector unit to provide free communication between those first ports and those second ports located adjacent said deflector unit, and means for moving said belt deflector unit along the length of said valving face to vary the selection of which of said first and second ports are brought into communication with one another by said deflector unit.

2. An apparatus as defined in claim 1 further characterized by means for producing a vacuum in said air plenum so that according to the position of said belt deflector unit along said valving surface a vacuum is produced in a selected at least one of said compartments to produce a vacuum on that portion of said work material support surface overlying such selected at least one compartment, the vacuum which appears at those second ports located remote from said belt deflector unit drawing said belt to said remote second ports to seal them against air flow therethrough.

3. An apparatus as defined in claim 1 further characterized by said valving member being part of a means defining a hollow chamber receiving said belt and belt deflector unit and which chamber is substantially closed against the ingress and egress of air except through said first and second ports, means for selectively providing either a vacuum or a positive air pressure in said air plenum, the application of vacuum to said air plenum by said latter means causing vacuum to be transmitted to a selected at least one of said compartments in dependence on the position of said deflector unit along the length of said valving face to produce a vacuum on that portion of said work material support surface overlying such selected at least one compartment with said belt in the portions thereof remote from said deflector unit being drawn to said valving face by the vacuum appearing at said second ports to seal such second ports against air flow therethrough, and the application of positive pressure to said air plenum by said latter means causing positive pressure to be transmitted to all of said compartments to in turn produce a positive pressure over all of said work material support surface because of the free communication existing between the first and second ports located at said belt deflector as a result of said deflector unit holding said belt away from said ports and also because of the positive pressure appearing at those second ports remote from said deflector unit displacing said belt from said valving face to allow flow of air between those second ports and those first ports located remote from said deflector unit.

4. An apparatus as defined in claim 1 further characterized by said belt deflector unit including a housing over which said belt moves as said unit is moved longitudinally of said valving face, said housing being closed on all sides except for an open face facing said valving face of the valving member.

5. An apparatus as defined in claim 1 further characterized by means for supporting said belt deflector unit for movement longitudinally of said valving face in a plane parallel to and fixed relative to said valving face.

6. An apparatus as defined in claim 1 further characterized by there being a plurality of said first and a plurality of said second ports for each of said compartments.

7. An apparatus as defined in claim 1 further characterized by said belt deflector unit including a housing over which said belt moves as said unit is moved longitudinally of said valving face, said housing being closed on all sides except for having an open face facing said valving face of the valving member, said housing having an edge extending along and defining the periphery of said open housing face which edge is located close to said valving face to inhibit the flow of air between said edge and said valving face.

8. An apparatus as defined in claim 7 further characterized by said housing being tapered at each of its ends longitudinally of said valving face so that as said housing moves onto or off of one of said first or second ports such port is gradually introduced to or removed from the space contained by said housing.

9. An apparatus as defined in claim 7 further characterized by two belt guide members carried by said belt deflector unit on opposite sides of said housing longitudinally of said belt, said guide members each extending transversely of said belt and said belt passing between it and said valving face, one of said guide members determining a transverse line at which said belt leaves said valving face and the other of said guide members determining a transverse line at which said belt returns to said valving face in its movement over said housing, said housing face edge having two opposite straight portions each located close to a respective one of said straight lines determined by said two belt guide members.

10. An apparatus as defined in claim 5 further characterized by said means for positioning the longitudinal portions of said belt located on either side of said deflector unit closely adjacent to said valving face including two guide members carried by and located on opposite longitudinal ends of said deflector unit, said belt passing between each of said guide members and said valving face and each of said guide members being positioned to hold that portion of the belt which passes between it and said valving face closely adjacent to said valving face.

11. An apparatus as defined in claim 10 further characterized by each of said two guides being a roller supported on said deflector unit for rotation about an axis fixed relative to said unit and extending transversely of said belt.

12. An apparatus as defined in claim 11 further characterized by third and fourth rollers carried by said deflector unit, said third and fourth rollers being located between said first two rollers, said third and fourth rollers being located between said belt and said valving face so that said belt is held by them in laterally spaced relation to said valving face.

13. An apparatus as defined in claim 10 further characterized by said means for positioning the longitudinal portions of said belt located on either side of said deflector unit closely adjacent to said valving face also including means at each end portion of said belt for fixing such belt end portion to said valving member with such end portion positioned flatly against said valving face.

14. An apparatus as defined in claim 1 further characterized by said compartments each extending transversely of said material support surface and said compartments being arranged side-by-side adjacent one another longitudinally of said support surface so that each of said compartments has a first transverse end located adjacent one longitudinal side edge of said support surface, said air valving member extending along said one longitudinal side edge of said support surface and having two separate longitudinally extending zones one of which contains said first ports and the other of which contains said second ports, the one of said zones of said valving member containing said first ports being located adjacent to and defining said first transverse ends of said compartments, and said means providing communication between said at least one first port of each of said areas and an exclusively associated one of said compartments comprising at least one hole passing through said valving member from said valving face to the compartment, said hole in the plane of said valving face defining the associated one of said first ports.

15. An apparatus as defined in claim 14 further characterized by said air plenum being located on the side of said valving member opposite from said valving face and extending along said valving member adjacent said second longitudinal zone thereof, said means providing communication between said at least one second port of each of said areas and said air plenum comprising a plurality of holes extending through said valving member from said valving face to said air plenum, each of said holes in the plane of said valving face defining one of said second ports there being at least one of said holes within the horizontal extent of said valving face matching the horizontal extent of each of said compartments.

16. An apparatus as defined in claim 1 further characterized by said valving member being one side of a four-sided hollow frame within which said deflector unit moves, said hollow frame including a side spaced from and parallel to said valving face, and means on said deflector unit engageable with said valving face and with said opposite side of said frame for supporting said deflector unit for movement longitudinally of said valving face while preventing it from moving in the direction perpendicular to said valving face.

17. An apparatus as defined in claim 16 further characterized by said four-sided hollow frame being comprised of a U-shaped channel member having a web and two flanges and a cover plate fastened to said two flanges and extending along the length thereof, said web of said U-shaped channel providing said valving member.

18. An apparatus as defined in claim 1 further characterized by a carriage movable along said support surface in one coordinate direction relative to said table, and means for moving said deflector unit relative to said valving member in response to movement of said carriage relative to said table in said one coordinate direction.

19. An apparatus as defined in claim 18 further characterized by a tool carried by said carriage for working on work material supported by said support surface.

20. An apparatus as defined in claim 19 further characterized by said tool being a cutter for cutting sheet material spread on said supporting surface.

21. An apparatus as defined in claim 20 further characterized by means for producing a vacuum in said air plenum so that a selected at least one of said compartments is thereby supplied with vacuum depending on the position of said belt deflector unit, and said movement of said belt deflector unit in response to said movement of said carriage relative to said table being such that said at least one of said compartments supplied with vacuum is the one underlying said cutting tool carried by said carriage.

22. An apparatus as defined in claim 21 further characterized by means for providing a positive air pressure in said air plenum, means for selectively connecting said air plenum to either said vacuum producing means or said positive pressure producing means, and said valving member being part of a means defining a hollow chamber receiving said belt and belt deflector unit and which chamber is substantially closed against the ingress and egress of air except through said first and second ports.

23. An apparatus as defined in claim 18 further characterized by means including a first motor for moving said carriage relative to said table in said one coordinate direction, and means including a second motor separate from said first motor for moving said belt deflector unit relative to said valving member.

24. An apparatus as defined in claim 23 further characterized by said means for moving said deflector unit in response to movement of said carriage including a linear variable differential transformer (LVDT) for sensing relative displacement between said carriage and said belt deflector unit.

25. An apparatus as defined in claim 24 further characterized by means supporting said belt deflector unit for its said movement along the length of said valving face, said belt, said belt deflector unit and said means supporting said belt deflector unit all being made substantially of non-ferromagnetic material, and said LVDT comprising a ferromagnetic core carried by said deflector unit and a coil unit, with exciting and sensing coils, carried by said carriage and positioned for cooperation with said core.

26. An apparatus as defined in claim 1 further characterized by said top layer of material providing said work material support surface being a bristle bed having bristles which define said support surface.

27. An apparatus as defined in claim 26 further characterized by said bristles being of such dimensions and being arranged in such density in said bed as to offer a substantial resistance to air flow through said bristle bed in a direction longtiudinally of said table.

28. A machine for working on sheet material, said machine comprising a table having an upwardly facing support surface for supporting one or more layers of sheet material spread thereon, and a carriage movable along said support surface in one coordinate direction relative to said table for carrying a tool for working on sheet material spread on said support surface, said table including a top layer of material providing said support surface and having air passages extending vertically therethrough and distributed thereover, means located below said top layer of material for vertically supporting said top layer and forming a plurality of compartments each having a top communicating with the air passages of that portion of said top layer overlying said compartment, means providing an air plenum, an elongated rigid air valving member having an elongated valving face extending along its length, said valving face having first and second longitudinal zones separate from one another extending along the length of said face and said valving face being divided along its length into a plurality of successive areas each assigned to a respective one of said compartments, said first longitudinal zone of said valving face having in it a plurality of first ports, there being at least one of said first ports in each of said successive areas of said valving face, means providing communication between said at least one first port of each of said successive areas and the one of said compartments to which such area is assigned, said second longitudinal zone of said valving face having in it a plurality of second ports distributed along its length, there being at least one of said first ports in each of said successive areas of said valving face, means providing communication between said second ports and said air plenum, a belt deflector unit movable along the length of said valving face, an air valving belt extending along the length of said valving face, cooperating with said belt deflector unit, and of sufficient width to fully overlie both of said first and second zones of said valving face, means causing said belt on either side of said deflector unit longitudinally of said valving face to be positioned close to said valving face, said belt deflector unit having means for deflecting said belt away from and holding it in spaced relation to said valving face at the location of said deflector unit to provide communication between those first ports and those second ports located adjacent said deflector unit, and means for moving said belt deflector unit along the length of said valving face in response to movement of said carriage relative to said table in said one coordinate direction.

29. A machine as defined in claim 28 further characterized by means supplying a vacuum to said air plenum.

30. An apparatus as defined in claim 29 further characterized by said top layer of material providing said work material support surface being a bristle bed having bristles of which define said support surface.

31. An apparatus as defined in claim 30 further characterized by said bristles being of such dimensions and being arranged in such density in said bed as to offer a substantial resistance to air flow through said bristle bed in a direction longtiudinally of said table.

32. A machine as defined in claim 28 further characterized by means for selectively supplying either a vacuum or a positive air pressure to said air plenum, and said valving member being part of a means defining a hollow chamber receiving said belt and belt deflector unit and which chamber is substantially closed against the ingress and egress of air except through said first and second ports.

33. A machine as defined in claim 28 further characterized by said valving member extending along the length of said table with each of said successive areas of said valving face having a horizontal extent matching the horizontal extent of an associated one of said compartments located on the opposite side of said valving member from said valving face.

* * * * *